United States Patent [19]

Dunn

[11] 4,093,216

[45] June 6, 1978

[54] POOL TABLE CONSTRUCTION AND ITS METHOD OF CONSTRUCTION

[76] Inventor: Ronald Lee Dunn, 2823 Knode Ct., Fort Wayne, Ind. 46806

[21] Appl. No.: 786,970

[22] Filed: Apr. 13, 1977

[51] Int. Cl.[2] ..... A63B 15/00

[52] U.S. Cl. ..... 273/6

[58] Field of Search ..... 273/2, 3 R, 3 A, 3 B, 273/3 C, 4 R, 4 A, 4 B, 4 C, 5 R, 5 A, 5 B, 5 C, 6, 7, 51, 8, 9, 10, 11 R, 11 C, 12, 13, 126 R

[56] References Cited

U.S. PATENT DOCUMENTS

| | | | |
|---|---|---|---|
| 253,544 | 2/1882 | McLean | 273/6 |
| 921,651 | 5/1909 | Bracher | 273/6 |
| 949,563 | 2/1910 | Bracher | 273/6 |
| 1,036,277 | 8/1912 | Lawrenz | 273/6 |
| 1,049,948 | 1/1913 | DeWater | 273/4 B |
| 1,151,470 | 8/1915 | Kade | 273/5 |
| 3,743,288 | 7/1973 | Danklefsen | 273/6 |
| 3,889,945 | 6/1975 | Ellis | 273/8 |

FOREIGN PATENT DOCUMENTS

| | | | |
|---|---|---|---|
| 417,994 | 6/1910 | France | 273/7 |
| 4,999 of | 1890 | United Kingdom | 273/6 |
| 320,404 | 10/1929 | United Kingdom | 273/3 A |

*Primary Examiner*—Richard C. Pinkham
*Assistant Examiner*—T. Brown
*Attorney, Agent, or Firm*—John A. Young

[57] ABSTRACT

A pool table and method of making same in which the playing surface, covered by felt, consists of tempered glass in sheet form, having semicircular notches formed at the corners and midsides at the pockets of the pool table. The notches can be formed either prior to tempering the glass or by laser beam cutting operation after the tempering operation.

7 Claims, 4 Drawing Figures

POOL TABLE CONSTRUCTION AND ITS METHOD OF CONSTRUCTION

BACKGROUND OF THE INVENTION

It has become almost universal practice in good pool table construction to use a thick layer of slate which is shaped to a nearly perfect flat condition before being covered by felt, which forms the actual playing surface of the pool table. The slate can either be formed of a single piece to conform with the finished dimensions of the pool table, or it can be formed in sections and then seamed or joined at the confronting surfaces of the slate sections. The slate is very heavy, but it does provide a hard and durable playing surface. Unfortunately, because of the weight of the slate and the technical difficulties involved in forming a flate slate surface, the pool table is, and has been for some time, expensive to manufacture. Pool is a game which has long enjoyed great popularity in the United States and in foreign countries as well, but unfortunately the cost of providing a slate pool table has put ownership of this item beyond the reach of many people. Slate is, as mentioned, a very popular and satisfactory playing surface, but it is subject to buckling, particularly if water warps the carrying surface for the slate, because the slate does not have the ability to support its own weight, and if the slate-supporting surface should bow, or distort, the slate will crack, particularly in those areas where it is seamed together. Even where the slate is made of a single piece, it will tend to buckle of its own weight, since it lacks a sufficient modulus of elasticity. Because of the heavy weight factor, pool tables are relatively immobile when once set up, as it is difficult to relocate and reset them in a new playing location, and the pool table has to be readjusted to be perfectly flat relative to the support surface of the floor.

A principal object of the present invention is to provide a playing surface of tempered glass which is in sheet form and supported rigidly by a substrate so as to provide an inexpensive, lightweight and dimensionally stable playing surface of durable nature, and one which can be easily installed and removed for resurfacing, as the need arises.

Other objects and features of the invention will become apparent from a consideration of the following description, which proceeds with reference to the accompanying drawings.

DETAILED DESCRIPTION OF THE INVENTION

Figure 1:
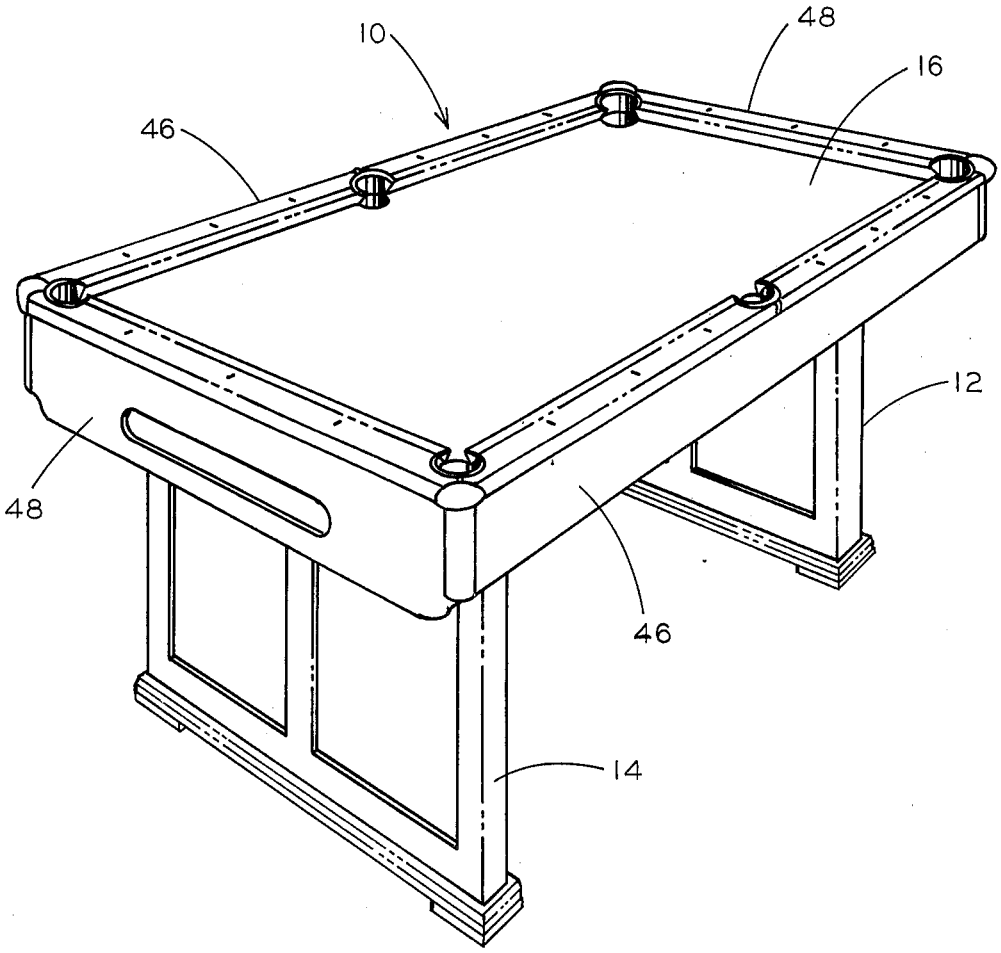
FIG. 1 is an isometric view of a pool table which is constructed in accordance with the present invention.
Figure 2:
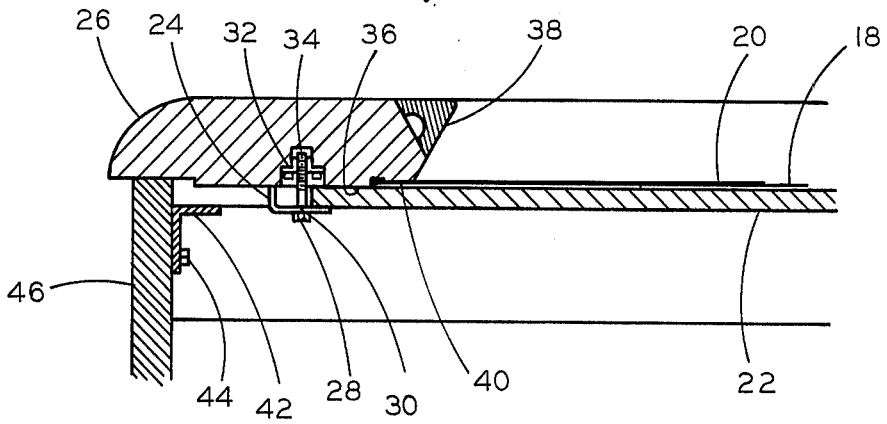
FIG. 2 is a section view taken on line 2—2 of FIG. 1.

Referring to FIG. 1, a pool table designated generally by reference numeral 10 is supported at its opposite ends by pedestals, or legs 12, 14. The pool table has a playing surface 16 which is provided by a sheet of tempered glass 18 having a felt covering 20. The sheet tempered glass lamination 18 is supported by a substrate of wood 22 and both the wood and the tempered glass are supported by means of a series of hangers 24 which are fixed to rails 26 extending around the outer periphery of the pool table. Each hanger 24 is supported by a bolt 28 received through an opening 30 of the hanger and screwed into a nut 32 which is secured within a socket 34 of the rail 26. When the bolts 28 are turned down, both substrate 22 and glass 18 are clamped against surface 36 of the rail 26. The glass lamination 18 is clamped within a notch 40 of the rail which is formed longitudinally in the undersurface of the rail 26. The glass lamination 18 is thus firmly supported both at its peripheral edges and is centrally supported against distortion. In this manner, a continuous flat playing area is formed throughout the pool table. The playing surface is thus substantially flat throughout the entire playing surface. Rail 26 has a bumper cushion 38 which cushions the impact of the pool balls. This is a resilient material which can allow the pool balls to be banked off the rails 26 in the usual manner.

In addition to the hangers 24, substrate 22 and rails 26 are supported through angles 42 which are bolted by means of bolts 44 under sideboards 46 or endboards 48 which in turn are carried by pedestals 12 and 14.

Figure 3A:
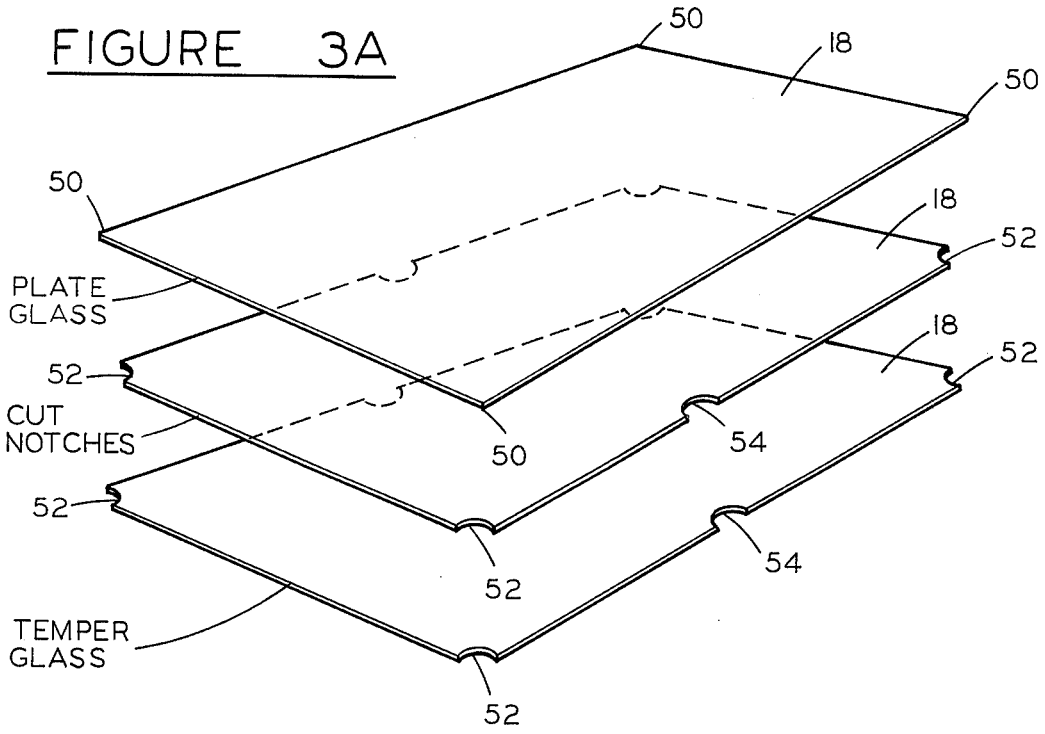
FIG. 3A is an exploded view showing the sequence of forming a flat sheet of glass first into a form adapting it for the pool table application of this invention and thereafter tempering it, and , FIG. 3B is a further modification of the sequence of FIG. 3A, showing how glass tempering can first occur and then the pockets formed by cutting through a laser beam operation.
Figure 3B:
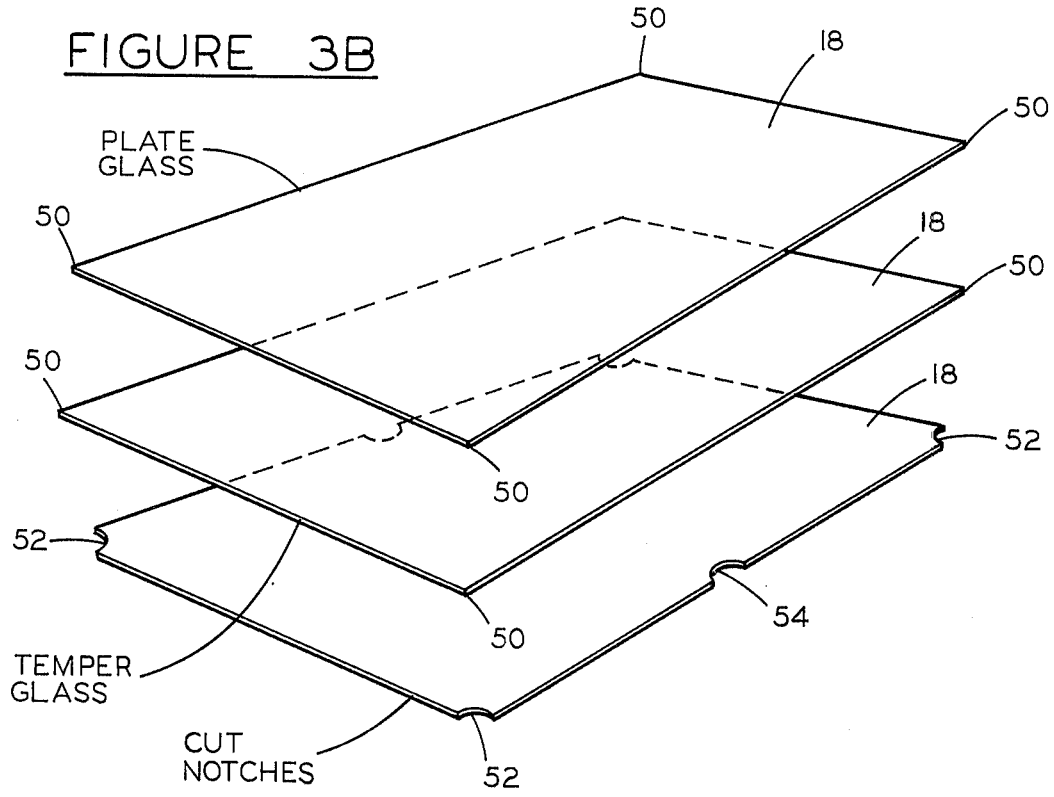

Referring next to FIGS. 3 and 4, the flat sheet of glass 18 is notched at corners 50 to form convexly curved cutouts or notches 52 (FIGS. 3, **3*b*) and additional notches 54 are formed at the side edges of the glass 18 and the resulting configuration is then tempered. If desired, the sheet glass 18** can be tempered and the same notches formed by laser beam cutting operation. Both of these expedients are contemplated within the scope and teaching of the present invention. As is well known, the glass, in order to be tempered, is heated to as high as 650° C and then quenched at about 300° C to chill the glass suddenly. The tempering increases the strength of the glass by 400%. Tempered glass has from 15,000 to 35,000 psi strength value far beyond conventional plate glass.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims.

What is claimed is:

1. A pool table construction comprising a substrate of wood extending substantially throughout both the length and width of the playing area of the pool table and forming a complete underlayer which provides a support for the playing surface, and a substantially flat sheet of tempered glass having strength of from about 15,000 to about 35,000 psi and which overlies said supporting substrate of wood to provide the playing surface for the pool table, and including cutouts at the four corners and midsides of said flat sheet of tempered glass, a fabric covering for said glass which lies flatly against the playing surface of the glass and provides the playing surface of the pool table, a series of rails surrounding said tempered glass to confine the pool table operation to the playing area, and a plurality of spaced pockets at the four corners and two midsides of said pool table and corresponding with said cutouts formed in said flat sheet of tempered glass.

2. The pool table construction in accordance with claim 1 in which the cutouts of said glass are preformed as convexly shaped cutouts prior to the tempering, which may be as high as 650° C.

3. The construction in accordance with claim 1 in which said cutouts are formed as convexly shaped cutouts subsequent to the tempering of said flat glass sheet and by laser beam cutting operation.

4. The pool table construction in accordance with claim 1 including a plurality of suspending elements, means for securing said suspending elements to the undersurface of said series of rails and including clamping portions which clamp said substrate and flat sheet of tempered glass within a notched area at the subsurface of said rails.

5. The pool table construction in accordance with claim 1 in which the orientation of said flat sheet of tempered glass is defined by said rails having a rectangular notched perimeter formed in the undersurface thereof and proportioned to receive extending edges of said plate glass to determine the planar orientation of said flat sheet of tempered glass.

6. The pool table in accordance with claim 1 including at least two support legs for positioning the playing surface of said pool table at a preferred vertical position, and leveling means for adjustably positioning each of the four corners of said pool table to effect a flat and level condition of the playing surface.

7. A method for producing a pool table comprising the steps of: forming a playing surface of tempered sheet glass material having a strength of from about 15,000 to about 35,000 psi which has been heated to a temperature as high was 650° C and thereafter cooled at about 300° C to suddenly chill the glass, said tempered sheet glass being configured to be of the same, or substantially the same, length and width of the pool table playing area, covering said tempered sheet glass with a fabric covering, thereafter suspending the covered tempered glass through a substrate of vertically supportive, rigid backing material, and thereafter clamping a combination of the substrate and tempered sheet glass to the perimeter of the pool table at the undersurface thereof.

* * * * *